United States Patent [19]

Joyce

[11] 4,399,571

[45] Aug. 23, 1983

[54] FOLDING BED FRAME STRUCTURE FOR SOFA BEDS OR THE LIKE

[75] Inventor: Tom B. Joyce, Mansfield, Ark.

[73] Assignees: Louis Pokorny, Jr.; John M. Pokorny, both of Ronkonkoma, N.Y.

[21] Appl. No.: 275,490

[22] Filed: Jun. 19, 1981

[51] Int. Cl.[3] ..... A47C 17/14

[52] U.S. Cl. ..... 5/13; 5/29

[58] Field of Search ..... 5/13, 29, 51 G

[56] References Cited

U.S. PATENT DOCUMENTS

| | | | |
|---|---|---|---|
| 1,288,682 | 12/1918 | Richardson | 5/51 G |
| 3,281,870 | 11/1966 | Katz | 5/13 |
| 3,284,811 | 11/1966 | Rogers | 5/13 |
| 3,395,409 | 8/1968 | Eakins | 5/13 |
| 3,868,733 | 3/1975 | Spitz et al. | 5/13 |
| 3,984,883 | 10/1976 | Wong | 5/13 |
| 4,253,205 | 3/1981 | Mikos | 5/13 |

FOREIGN PATENT DOCUMENTS

| | | |
|---|---|---|
| 391570 | 5/1933 | United Kingdom . |
| 395485 | 7/1933 | United Kingdom . |
| 426160 | 3/1935 | United Kingdom . |

*Primary Examiner*—Ramon S. Britts
*Assistant Examiner*—Michael F. Trettel
*Attorney, Agent, or Firm*—Alan H. Levine

[57] ABSTRACT

A folding sofa bed frame having head, intermediate and foot bed sections pivotally connected end-to-end and supported and constrained by a linkage arrangement to move in a predetermined pattern between a folded position and a horizontally extended position. A link supports the head and main intermediate sections at their pivotal connection and an actuating link controls movement of the head section, the head section being braced in a horizontal disposition in the extended position by the superposed abutment of the support link by the actuating link. To facilitate shipping, the head section is partially foldable and pivotable independently of the linkage arrangement and the other bed sections to permit folding thereof between the main intermediate and foot sections during folding movement of the frame from its extended to its folded position. The linkage arrangement includes a rear support link having a fixed pivot at one end and a traveling pivot at the other, a fixed stop being disposed to abut the rear support link during an initial portion of movement of the frame from the folded to the extended position and during the corresponding final portion of movement from the extended to the folded position to fix the traveling pivot and cause the frame to pivot thereabout in a tighter, more compact path during such initial and final movements.

10 Claims, 11 Drawing Figures

36
48
50
84
82
46
80'
86
78'
50
79
80
72
78
74
88
38
26
66
50
76
54
69
42
103
68
34
28
62
58
64
70
52
30
40
94'
96
96'
60
94
100
32
106
105
56
22
90
24

26
28
38
40
94
94'
42
96
100
103
60
68
66
62
86
84
36
82
88
72
80
78
76
30
58
106
56
70'
70
64
104
90
32'
102
32
34
A
44

26
28
40
94
94'
42
96
100
103
60
68
66
62
86
84
38
36
82
88
74
80
76
72
78
30
58
104
105
56
70'
70
64
106
32'
102
32
34
B
90
22
44

FOLDING BED FRAME STRUCTURE FOR SOFA BEDS OR THE LIKE

BACKGROUND OF THE INVENTION

The present invention relates to folding bed frame structures and more particularly to folding bed frames of the type specially adapted for opening and folding articulation from and into the enclosure of a sofa frame or the like.

Convertible sofa beds having widely varying folding bed frame structures are in common use. Characteristically, the folding bed frames of such sofa beds are provided with a plurality of bed sections pivotally connected in end-to-end relation and operatively associated with a linkage arrangement for mounting within the rectangular enclosure of a sofa bed frame defined by its side frame members, which normally comprise the sofa arm rests, its sofa back and a front rail, to be articulable between a folded or retracted condition stored within the sofa frame enclosure and a horizontally extended condition disposed and extending outwardly from the enclosure over and beyond the front rail of the sofa frame.

Substantial activity has heretofore been devoted to the improvement of folding bed frame structures of this type, a significant amount of which activity has been directed toward the common objective of providing a simple linkage arrangement which is compactly foldable and which requires a minimal amount of space for articulating the bed sections into and out of the enclosure of the sofa frame. The linkage arrangements of many of the relatively early folding bed frame designs provided a support and actuating linkage designed for affixation interiorly to a sofa frame which linkage operatively connected with both the head support section of the bed frame structure arranged to be disposed most rearwardly, i.e., toward the sofa back in the extended condition of the frame, and the intermediate bed section pivotably connected to the head section, the intermediate section normally being the main supporting section of the extended bed. To avoid engagement with the seat back portion of the sofa frame in the folding and unfolding operation of the bed frame, some such folding bed frame structures were arranged to fold and be stored within the sofa frame below and forwardly of the seat back thereof, an example of such structures being disclosed in W. C. Rogers, Jr., U.S. Pat. No. 3,247,526. This manner of storage arrangement often resulted in the non-use of a significant amount of the available storage space within the sofa frame rearwardly below the seat back, as can be seen in the latter cited patent. Moreover, while being generally operable for folding and unfolding the bed sections of the bed frame, the support and actuating linkages of such bed frame structures generally occupied a greater than desirable storage area within the sofa frame in the folded condition and required a greater than desirable area of movement in unfolding to the extended position.

In attempting to better use the available storage space within the sofa frame, other folding bed frame structures were arranged such that a part of the linkage arrangement and/or the head support section would be disposed rearwardly in an upstanding disposition in the folded condition thereby to take advantage of the available storage space within the hollow seat back of the sofa frame. Such structures necessarily presented problems in designing the linkage arrangement to articulate the portions of the structure thus stored around the lower forward portion of the seat back in folding and unfolding operation. Characteristically, the satisfaction of this necessity resulted in the provision of a support and actuating linkage of significantly increased complication which required a greater amount of storage and operational space, the sofas which incorporated such bed frame structures accordingly normally being constructed with disproportionately deep seat backs. Examples of this type of folding bed structure are disclosed in Woller U.S. Pat. No. 2,352,989, Rogers U.S. Pat. Nos. 3,165,757 and 3,298,041, Rea U.S. Pat. No. 3,258,786, and Pokorny U.S. Pat. Nos. 3,178,731 and 3,321,777. As will be appreciated, such bed frame structures thus generally defeated the purpose for which they were designed.

One alternate linkage arrangement which has had significant attention provides a support and actuating linkage which operatively directly connects only to the main intermediate bed section and utilizes an associated actuating linkage arrangement to control the folding and unfolding movement of the head support section, thereby freeing the head section of complicated associated support linkage so that it may be folded uprightly within a relatively narrow hollow seat back. Examples of such bed frame structures are disclosed in Rogers U.S. Pat. No. 3,284,811, Pokorny U.S. Pat. No. 3,416,168, and Mikos U.S. Pat. No. 3,516,096. While such bed frame structures essentially represent the present state of the art, certain problems still accompany their use. Initially, since the head support section folds within the seat back which normally will be narrow for aesthetic furniture design purposes, there exists the requirement of a support and actuating linkage arrangement which will articulate the head section around the seat back. Generally, the linkage arrangement will provide for an initial lowering of the rearward portion of the folded structure in moving from the folded to extended condition and accordingly requires a greater than desirable area beneath the folded structure to accomodate such movement. Additionally, the head section of bed frame structures of this type are sometimes inadequately supported in the extended condition producing a tendency for downward pivoting of the head section about its pivotal connection with the intermediate section to which it is connected beyond a horizontal disposition under loads.

An associated problem with these and all other folding bed frame structures which are designed to fold in a manner whereby a portion thereof assumes an upstanding disposition for storage within the seat back of a sofa frame is that structures of this type generally are not susceptible of compact stacking for shipping and storage thereof. Substantially none of the furniture manufacturers which produce sofa beds manufacture the bed frame structures incorporated therein. Such structures are instead purchased from other manufacturers specializing in their production and, accordingly, must be shipped from the manufacturer thereof to the furniture manufacturer. The compact folding of the structures to a stackable disposition for storage or shipment is therefore, a concern equally important to those discussed above. Preferably, the structures should be foldable to a compact, generally rectangular prismatic shape. Metayer U.S. Pat. No. 3,903,553 discloses a bed frame structure wherein the linkage arrangement provides for the automatic operative folding of the head support section between the forwardmost bed section, i.e., the foot support section, and the main intermediate section thereof. While this bed frame structure therefore better facilitates shipping of the frame than do other bed frames, it is precluded from utilizing the advantage of folding the head section within the seat back in the finished sofa bed. To this end, Wong U.S. Pat. No. 3,984,883, discloses the provision of a disconnectable actuating link in the head section actuating linkage whereby such linkage can be disconnected so that the head section may be pivoted forwardly between the foot support section and the intermediate section in the folded condition to provide a compact folding of the structure which will facilitate shipping and storage thereof. Reconnection of the linkage is performed by the furniture manufacturer for ordinary operative folding and unfolding of the bed frame structure.

In contrast to the above, the present invention provides a folding bed frame structure of the type having a head section free and unsupported directly by the support linkage of the structure and adapted to move between the folded and extended positions of the structure so as to permit disposition in its folded condition within the seat back of a sofa frame, wherein a unique bracing arrangement is provided to rigidly maintain the head section horizontally in the extended condition, a stop arrangement is provided to cause the head section to move in a tighter, more compact arcuate path during its initial and final portions of movement, respectively, from the folded to the extended position and from the extended to the folded position, and a combined arrangement of a partially independently foldable head section with a lost motion arrangement in the head section actuating linkage is provided for selective folding of the head section between the foot and main intermediate bed sections during folding of the bed frame from its extended in its folded disposition.

SUMMARY OF THE INVENTION

The present invention provides improvements in a folding bed frame structure of the type having a plurality of bed sections pivotally connected in end-to-end relation and linkage means adapted for affixation to a sofa frame or the like and operably associated with the bed sections for supporting them on the sofa frame and controlling their movement in a predetermined pattern between a rearward retracted position in which the sections are folded within the sofa frame relative to one another and a forward extended position in which the bed sections are horizontally aligned. In the preferred embodiment, the bed frame structure includes four bed sections: a head support section or rear end section, a first or main intermediate section pivotally connected to the head support section, a second intermediate section pivotally connected to the first intermediate section, and a foot support section or forward end section. The linkage means is preferably arranged to cause the rear end section to assume a rearward generally upstanding disposition in the retracted position and to cause the first and second intermediate and forward end sections to be foldedly disposed forwardly thereof with the first intermediate and forward end sections disposed horizontally in spaced superposed substantially parallel relation.

According to one feature of the present invention, the linkage means includes a support link arrangement pivotally connected to the first or main intermediate bed section for supporting the rear end first intermediate sections and an actuating link arrangement pivotably affixed to the rear end portion at a spacing from its pivotal connection with the first intermediate section for transmitting movement of the linkage means to the rear end section. The linkage means is arranged for superposed abutment in the extended position of the support link arrangement by the actuating link arrangement to supportingly brace the rear end section in horizontal alignment with the first intermediate section and to prevent undesirably downward pivotal movement of the rear end section about its pivotal connection with the first intermediate section beyond such horizontal alignment.

In the preferred embodiment of the present invention, the support link arrangement is pivotally connected at one end thereof to the pivotal connection between the rear end section and the first intermediate section and the actuating link arrangement is arranged to extend in the extended position from the location of its pivotal connection with the rear end section toward the opposite end of the bed frame structure for the aforesaid superposed abutment with the one end of the support link arrangement. The actuating link arrangement is provided with a transversely offset portion at a spacing from its pivotal connection with the rear end section to provide for such superposed abutment.

According to a second feature of the present invention, the rear end section is arranged for at least partial further folding thereof independently of the linkage means and of the intermediate and forward end sections and the linkage means includes a lost motion arrangement at the connection between the actuating link arrangement and the rear end section for permitting a predetermined amount of pivotal movement of the rear end section about its pivotal connection with the first intermediate section independently of the linkage means. In this manner, the rear end section may be selectively folded between the first intermediate section and the forward end section during movement of the bed sections from the extended position to the retracted position.

In the preferred embodiment of the present invention, the rear end section includes a primary portion pivotally connected to the inner section and a secondary portion pivotally supported on the primary portion for movement between a normal position superposed on and substantially parallel with the primary portion and a partially folded position pivotally disposed at an angular spacing from the primary portion to thereby provide the aforesaid partial independent folding capability of the rear end section. The rear end section is further provided with a secondary control link arrangement for guiding the pivotal movement of the secondary portion angularly with respect to the primary portion, the secondary control link arrangement extending between and being pivotably connected to the primary and secondary portions at respective spacings from the location of the pivotal connection therebetween. One of the pivotal connections between the secondary control link arrangement and the primary and secondary portions includes a lost motion means permitting a predetermined amount of guided movement of the secondary portion with respect to the primary portion.

According to a third feature of the present invention, the aforementioned support link means is adapted for affixation to the sofa frame and has a fixed pivot at the location of affixation thereof to the frame and a traveling pivot spaced therefrom, the support link means being arranged for movement of the traveling pivot between a location rearwardly of the fixed pivot in the retracted position and another location forwardly of the rearward location in the extended position and the linkage means being arranged for pivotal movement of the bed sections about both the traveling and fixed pivots during movement of the bed sections between the retracted and extended positions. Immovable stop means are disposed for being in engagement with the support line arrangement intermediate the fixed and traveling pivots during an initial portion of the movement of the bed sections from the retracted position toward the extended position and during a final portion of the movement of the bed sections rom the extended position to the retracted position. In this manner, the traveling pivot is effectively fixed during the initial and final portions of the movements of the bed sections thereby causing the bed sections to pivot about a more rearward point than the fixed pivot. As a result, the rearwardmost extent of the plurality of bed sections moves in a tighter, more compact arcuate path during such initial and final movements than during the other portions of the movements of the bed sections between the retracted and extended positions and will, therefore, fit into a smaller space in the sofa frame.

In the preferred embodiment of the present invention, the support link arrangement includes a support bracket for affixation to the sofa frame, the fixed pivot being formed on and the immovable stop means being affixed to the support bracket. The support link arrangement preferably includes a support link extending between the fixed and traveling pivots at each opposite side of the bed sections, the stop means being arranged at each such opposite side to respectively engage the support links.

To adapt the bed frame structure for use in a sofa frame of the type having an upright, horizontally extending seat back, the support link arrangement and the stop means are cooperatively arranged to cause the rear end section to move substantially vertically during the aforesaid initial and final portions of movement and the linkage means is further arranged to cause the rear end section to move downwardly and generally horizontally immediately following and preceding the initial and final portions of movements, respectively. In this manner, the bed frame structure is capable of compactly folding within the sofa frame in the retracted position with the rear end section disposed behind the seat back of the sofa frame and with the other bed sections of the plurality of bed sections disposed below the seat back and is further capable of moving between the retracted and extended positions with the movement of the rear end section unobstructed by the seat back of the sofa frame.

DESCRIPTION OF THE PREFERRED EMBODIMENT

Figure 1:
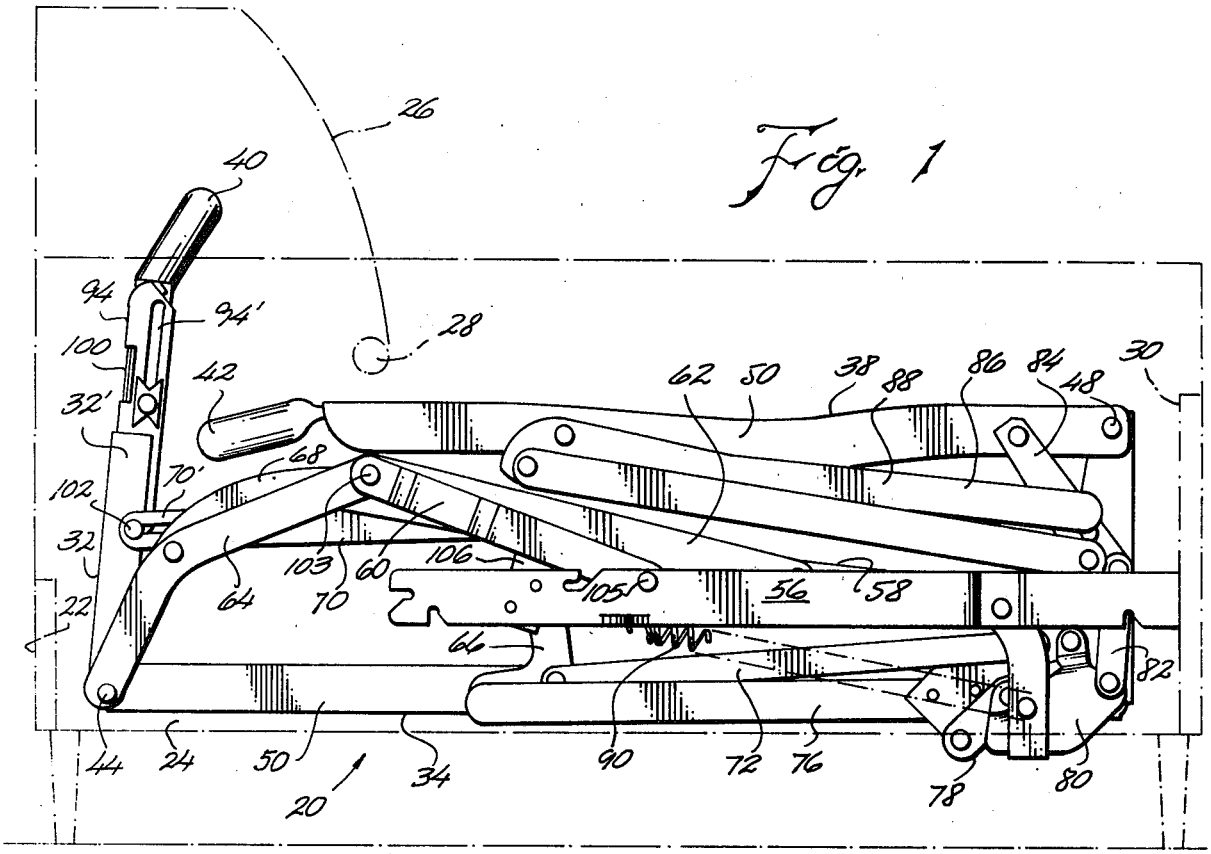
FIGS. 1–4 are side elevational views of an end portion of a sofa bed in which is mounted the preferred embodiment of the folding bed frame structure of the present invention, illustrating the bed frame structure in successive positions in its movement from its retracted position in FIG. 1 to its fully extended position of FIG. 4, the sofa frame being shown schematically in phantom for clarity of illustration of the bed frame structure.

Referring now to the accompanying drawings and initially to FIGS. 1–4, the folding bed frame structure of the present invention is generally indicated at 20 in FIG. 1 and is illustrated in the preferred embodiment thereof in a sofa frame 22 of conventional construction. The sofa frame 22 forms no part of the present invention and therefore is illustrated schematically and in phantom lines in the accompanying drawings to enhance the clarity of illustration of the folding bed frame structure 20. As is conventional, the sofa frame 22 basically comprises a pair of upstanding side frame members 24 spaced in parallel relation to form the sofa arm rests, an upright hollow seat back 26 extending horizontally between corresponding sides of the side frame members 24 and including a cross-member 28 forming a back support, and a front rail 30 extending horizontally between the other corresponding sides of the side frame members 24 in parallel relation to the seat back 26.

The folding bed frame structure basically includes four bed sections 32, 34, 36, 38 pivotally connected in end-to-end relation and a linkage arrangement adapted for affixation interiorly to the sofa frame 22 and operably associated with the bed sections 32,34,36,38 for supporting them on the sofa frame 22 and articulably actuating and controlling pivotal movement of the bed sections 32,34,36,38 in a predetermined pattern between a rearwardly retracted position in which the bed sections 32,34,36,38 are folded relative to one another within the enclosure of the sofa frame 22 and a forwardly extended position in which the bed sections 32,34,36,38 are horizontally aligned. As used herein, the terms "forward", "rearward" and "intermediate" and variations thereof define positions of the folding bed frame structure 20 relative to the sofa frame 22 and the manner in which the bed frame structure 20 is adapted to be relatively disposed therewithin, "forward" being the direction from the seat back 26 toward the front rail 30 generally parallel with the extent of the side frame members 24 and "rearward" being the opposite direction.

As will be understood, the folding bed frame structure 20 extends between the side frame members 24 substantially the width of the sofa frame 22 and includes identical bed section and linkage components at each side, each components being operably associated for simultaneous identical movement in a conventional manner by spaced cross-members extending between the bed sections, such as U-shaped members 40,42 at the rearward and forward ends, respectively, of the bed sections 32,38. As the components of the folding bed frame structure 20 are identical at each side, only the components at one side thereof are herein illustrated and described. It will also be understood that a bed spring and fabric covering therefor extend across the bed sections 32,34,36,38 in known fashion to provide a supporting surface for a mattress, the mattress and bed spring arrangement providing in a conventional manner a horizontal surface for support thereon of the seat cushions of the sofa in the aforementioned folded position of the bed frame structure 20 within the sofa frame 22. Neither the bed spring and covering arrangement nor the mattress form any part of the present invention and, accordingly, they are not shown in the drawings in the interest of clarity of illustration.

Looking now in greater detail to the bed frame structure 20 in FIGS. 1-4, the bed sections 32,34,36,38 include a rear end or head support section 32 one end of which is free and unsupported and the other end of which is pivotably connected at 44 to an end of a first intermediate section 34 which forms the main supporting section of the bed sections. The main intermediate section 34 is pivotably connected at its other end to an end of a second intermediate section 36 at 46, which is pivotally connected at its other end at 48 to an end of a forward end or foot support section 38. As is conventional, each bed section 32,34,36,38 is formed of opposed side rails 50 connected as noted above by cross-members, the free ends of the side rails 50 of the head support section 32 being joined by a U-shaped tubular member 40 or the like and the free ends of the side rails of the foot support section being similarly joined by a link tubular member 42. Preferably, the side rails 50 are conventional angle members having two flanges which extend substantially perpendicularly relative to one another such that, in the extended position, the corresponding flanges of each bed section align to form a vertical flange and a horizontal flange extending inwardly therefrom.

Figure 2:
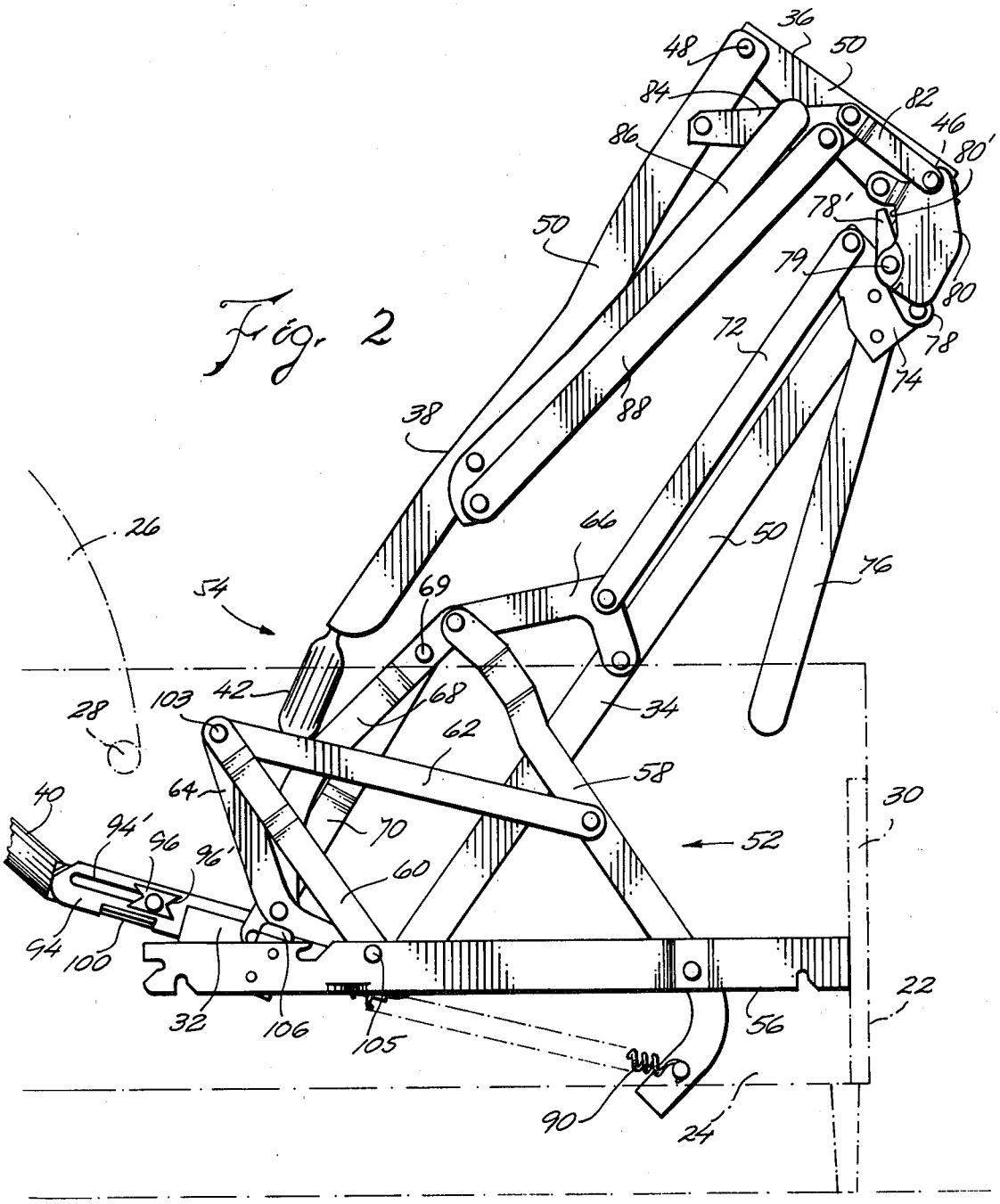
Figure 3:
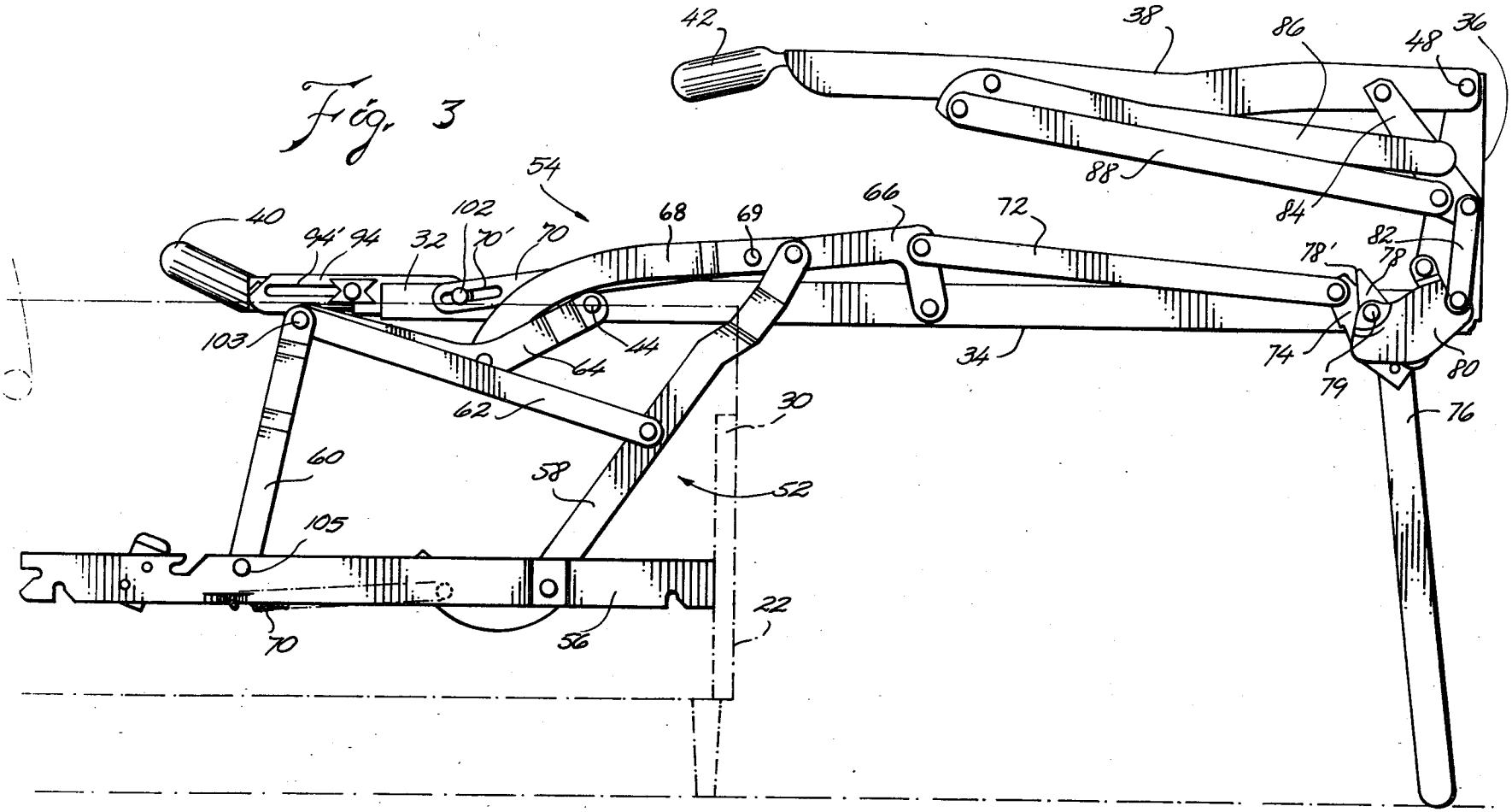

The linkage arrangement of the bed frame structure 20 basically comprises a support linkage arrangement, indicated generally at 52 in FIGS. 2 and 3, for supporting the bed sections 32,34,36,38 on the sofa frame through their movement between their folded and extended positions and an actuating and control linkage arrangement, indicated generally at 54 in FIGS. 2 and 3, associated with the support linkage 52 for transmitting folding and unfolding movement to the bed sections 32,34,36,38. As will be hereinafter explained in greater detail, the supporting linkage 52 and the actuating and control linkage 54 are cooperatively arranged to cause the bed sections 32,34,36,38 to fold relative to one another within the sofa frame 22 with the rear end section 32 in an upstanding disposition extending upwardly within the hollow sofa back 26, and with the main intermediate and forward end sections 34,38 disposed forwardly of the rear end section 32 in superposed, substantially parallel relation spaced apart by the second intermediate section 36 which assumes a vertical disposition forwardly of the main intermediate and forward sections 34,38, and to cause the bed sections 32,34,36,38 to articulably unfold from such folded disposition around the cross-member 28 of the sofa back and upwardly from the sofa frame enclosure over the front rail 30 to the horizontally aligned extended position.

The support linkage 52 includes a horizontal support bracket 56 adapted for affixation interiorly to the side frame members 24 of the sofa frame 22, two primary support links 58,60, being pivotably affixed at a horizontal spacing to the support bracket 56. As can be seen from the drawings, the forward support link 58 is substantially longer than the rear support link 60. A control link 62 extends between the two support links 58,60, the control link 62 being pivotably affixed at one end thereof to the outward free end of the rear support link 60 and being pivotably affixed at the other end thereof intermediately to the front support link 58. One end of a secondary support link 64 is also pivotably affixed with the rear support link 60 and the control link 62 at the outward free end of the rear support link 60 and extends therefrom and is pivotally connected to the main intermediate bed section 34 at its pivot 44 with the rear end bed section 32, to thereby provide support for such bed sections 32,34. One arm of a bell crank 66 is pivotably affixed to the outward free end of the front support link 58 with the other end of the bell crank 66 being pivotably affixed to the vertical flange of the side rail 50 forming the main intermediate section 34 intermediate the pivots 44,46 at the ends of the main intermediate section 34, thereby providing additional support for such bed section 34.

The actuating and control linkage 54 extends in association with the four bed sections 32,34,36,38 substantially the length thereof. A curved rear end section control link 68 is pivotably affixed at one end thereof to the secondary support link 64 intermediate its ends and extends to the outward free end of the front support link 58 at which the control link 68 is pivoted commonly with the front support link 58 and the bell crank 66. A rear end section actuating link 70 is pivoted at one end thereof to the control link 68 at 69, a slight spacing from the pivot point between the control link 68 and the front support link 58, and extends therefrom to a point intermediate the ends of the rear end section 32 at which point the actuating link 70 is pivotally connected to the vertical flange of the side rail of the rear end section 32, the control line 68 and actuating link 70 being thus arranged to respectively transmit folding and unfolding movement to the rear end section 32 as hereinafter more fully explained.

As will be understood, the main intermediate section 34 is horizontally disposed in both the folded and extended positions and moves between the positions to a substantially translatory manner. A support leg 76 is pivoted to the main intermediate section 34 adjacent its forward end at a slight spacing from the pivot 46 to provide additional support for the main intermediate section 34 in the extended position. An actuating link 72 extends between and is pivotably connected at its opposite ends to the bell crank 66 at an intermediate point thereon and to one arm of a lever 74 medially fulcrumed on the upper end of the support leg 76, the actuating link 72 being thereby arranged to actuate pivoting of the support leg 76 between a folded disposition alongside the main intermediate section 34 and a vertical disposition depending from the main intermediate section 34 upon the movement of the bed sections 32,34,36,38 between their folded and extended positions, respectively.

A collapsible articulation is provided between the lever 74 and the second intermediate and forward end sections 36,38 to allow the translatory movement of the main intermediate section 34 between the folded and extended positions and the unfolding of the leg 76 into its vertical supporting disposition to both occur before any further unfolding of the bed structure 20, specifically before the unfolding of the second intermediate and forward end sections 36,38, can be effected (see FIG. 3). Similarly, during the refolding of the bed structure 20 the second intermediate and forward end sections 36,38 can be moved from the extended position to the position of FIG. 3 to fold the forward end section 38 into superposed spaced parallel relation to the main intermediate section 34 before any movement of the bed frame structure 20 into the enclosure of the sofa frame 22 begins. Thus, any instability of the sofa during these maneuvers which might tend to topple the entire structure is prevented. This articulation which will presently be described in substantially conventional, an earlier form thereof being disclosed in U.S. Pat. No. 3,321,777, to L. Pokorny, Jr.

The afore-mentioned lever 74 comprises part of the collapsible articulation, the other arm, i.e., the arm not connected to the link 72, of the lever 74 extending from its fulcrum to and being pivotably connected with an end of a connecting link 78. The connecting link 78 is pivotably connected at 79 to a second lever 80 which is fulcrumed on the second intermediate section 36 at a slight spacing from its pivot 46 with the main intermediate section 34. Intermediate its pivotal connections with the connecting link 78 and the second intermediate section 36, the second lever 80 is pivotally connected to one end of a second connecting link 82 the other end of which is pivotally connected to an end of a third connecting link 84 pivoted at its other end to the forward end section 38 adjacent its pivot 48 with the second intermediate section 36. A link 83 (FIG. 48) is pivoted at one end on the second intermediate section 36 and at its other end commonly with the pivot between the second and third connecting links 82,84, to provide support for such connecting links 82,84. The connecting link 78 is provided with an extending portion 78' beyond its pivot with the second lever 80 which portion 78' is adapted to abut a surface 80' of the second lever 80 in the extended position. As will be understood, the connecting link 78, being independent of any direct connection with any of the main or second intermediate or forward end bed sections 34,36,38, does not transmit to the second intermediate and forward end sections 36,38, any of the movement of the bed sections or the actuating and control linkage occurring during movement of the bed structure 20 between the positions of FIGS. 1 and 3, and thereby facilitate the afore-mentioned collapsible articulation.

A forward support leg 86 is pivotably connected to the forward end section 38 adjacent its forward free end to provide support therefor in the extended position. An actuating link 88 is pivotally connected at its opposite ends respectively to the third connecting link 84 and to the upper end of the forward leg 86 for actuating movement of the forward leg 86 between a folded disposition alongside the forward end portion 38 in the folded position of the bed structure 20 and a vertical supporting disposition depending from the forward end section 38 in the extended positions.

The operation of the bed frame structure 20 will thus be understood. Initially, the seat cushions of the sofa are removed. With the bed frame structure 20 in the folded condition of FIG. 1, the underside of the bed spring and fabric cover arrangement extending between the side rails of the forward end bed section 38 faces upwardly. According to conventional practice a handle member (not shown) is provided adjacent the front rail, either formed in the bed spring and cover arrangement or formed on a cross member between the side rails of the forward end section 38, whereby the structure 20 may be manually lifted from its stored position. As can be seen from FIG. 1, the two primary support links 58,60 and the control link 62 therebetween are foldedly disposed in general alignment alongside one another. The exertion of a lifting force to the structure through the handle member operates to swingably pivot the support links 58,60 in a clockwise manner (as viewed in FIGS. 1–4), the control link 62 constraining the support links 58,60 to move in general parallel relation. As the support links 58,60 thus move from the position of FIG. 1 to the position of FIG. 2, the positions of the remaining components of the bed frame structure 20 relative to one another are generally unchanged, such remaining components moving with and pivoting about the pivot points at the respective outward moving ends of the two support links 58,60, in a generally counterclockwise manner, the rearwardmost portion of the folded structure 20 pivoting and moving downwardly and forwardly while the forwardmost portion of the structure 20 moves substantially vertically. In this manner, the rear end section 32 is manipulated downwardly from within the hollow seat back 26 and the forwardmost portion of the structure 20 is raised for movement over the front rail 30. A coil spring 90 extending rearwardly between a portion of the forward support link 58 which extends downwardly past the location of its pivotal activation to the support bracket 56 and a point on the support bracket 56 adjacent the fixed pivot point thereon of the rear support link 60, biases the front support link 58, and indirectly the rear support link, toward the pivoted, elevated position of FIG. 3 and thereby aids in moving the bed structure 20 between the positions of FIGS. 1 and 3 and reduces the lifting effort required to effect such movement.

As the bed structure 20 is lifted to the position of FIG. 2, and begins to move therepast, the pivot points at the outer ends of the support links 58,60, begin to approach respective positions vertically above the fixed pivot points of their support links 58,60 on the support bracket 56 and their arcuate movement accordingly becomes generally horizontal, thus beginning to move the structure 20 forwardly over the front rail 30. The bell crank 66 pivots generally counterclockwise about its pivotal connection with the front support link 58 to a disposition forwardly of the front support link 58 (FIG. 2) and thereafter begins to also pivot clockwise about its pivotal connection with the main intermediate section 34, the clockwise movement of the bell crank 66 pulling the actuating link 72 rearwardly to pivot the support leg 76 outwardly from alongside the main intermediate section 34 and into its aforesaid vertical supporting disposition depending therefrom (FIG. 3). As the support links 58,60 pivot from the position of FIG. 1 to and through the disposition of FIG. 2, the secondary support link 64 pivots counterclockwise about its pivotal connection with the rear support link 60 to raise the pivotal connection 44 at the other end of the secondary support link 64 between the rear end and main intermediate sections 32,34. The pivotal movement of the secondary support link 64 and of the forward support link 58 conjunctively cause the control link 68 extending therebetween to move forwardly therewith, thereby exerting a forward pulling force through the actuating link 70. As will be understood, the upward force of the secondary support link 64 on the pivot 44 acts to move the main intermediate section 34 from the inclined disposition of FIG. 2 into the horizontal disposition of FIG. 3. Furthermore, such upward force of the secondary support link 64 on the pivot 44 in combination with the pulling force of the movement of the actuating link 70 together act to cause the rear end section 32 to pivot counterclockwise to a horizontal position (FIG. 3), and thereby to manipulate around the cross-member 28 of the seat back 26.

As can be seen from the FIGS. 1–3, the relative positions of the main intermediate, second intermediate and forward end sections 34,36,38 and the collapsible articulation therebetween remain unchanged through the above-described movement. In the position of FIG. 3, the bed frame structure 20 is supported in a stable disposition with its rear end and main intermediate sections 32,34 supported in horizontal disposition by the support links 58,60,64 and by the support leg 76. The second intermediate and forward end sections 36,38 are moved into horizontal alignment with the rear end and main intermediate sections 32,34 by manual pulling forwardly on the cross-member 42 to initially cause the second intermediate section 36 to pivot clockwise about its pivot 46 with the main intermediate section 34 and to thereafter cause the forward end section 38 to pivot clockwise about its pivot 48 with the second intermediate section 36. The afore-described collapsible articulation extends as such movement occurs, the extending pivotal movement of the third connecting link 84 exerting a rearward pulling force on the actuating link 88 to pivot the forward support leg 86 downward into its depending supporting disposition. The construction and operation of this collapsible articulation being conventional, it will not be further described herein.

Figure 4A:
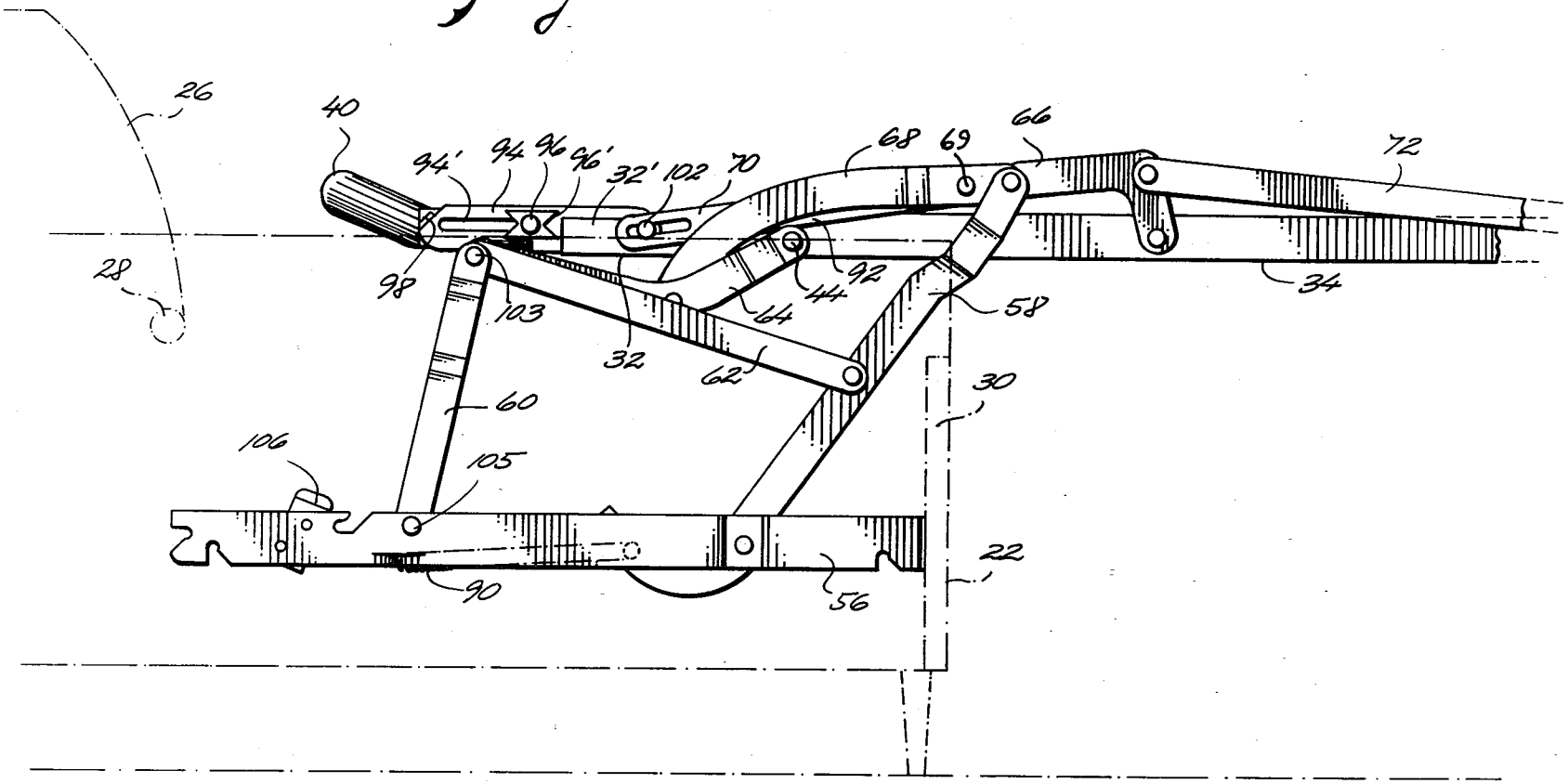
Figure 4B:
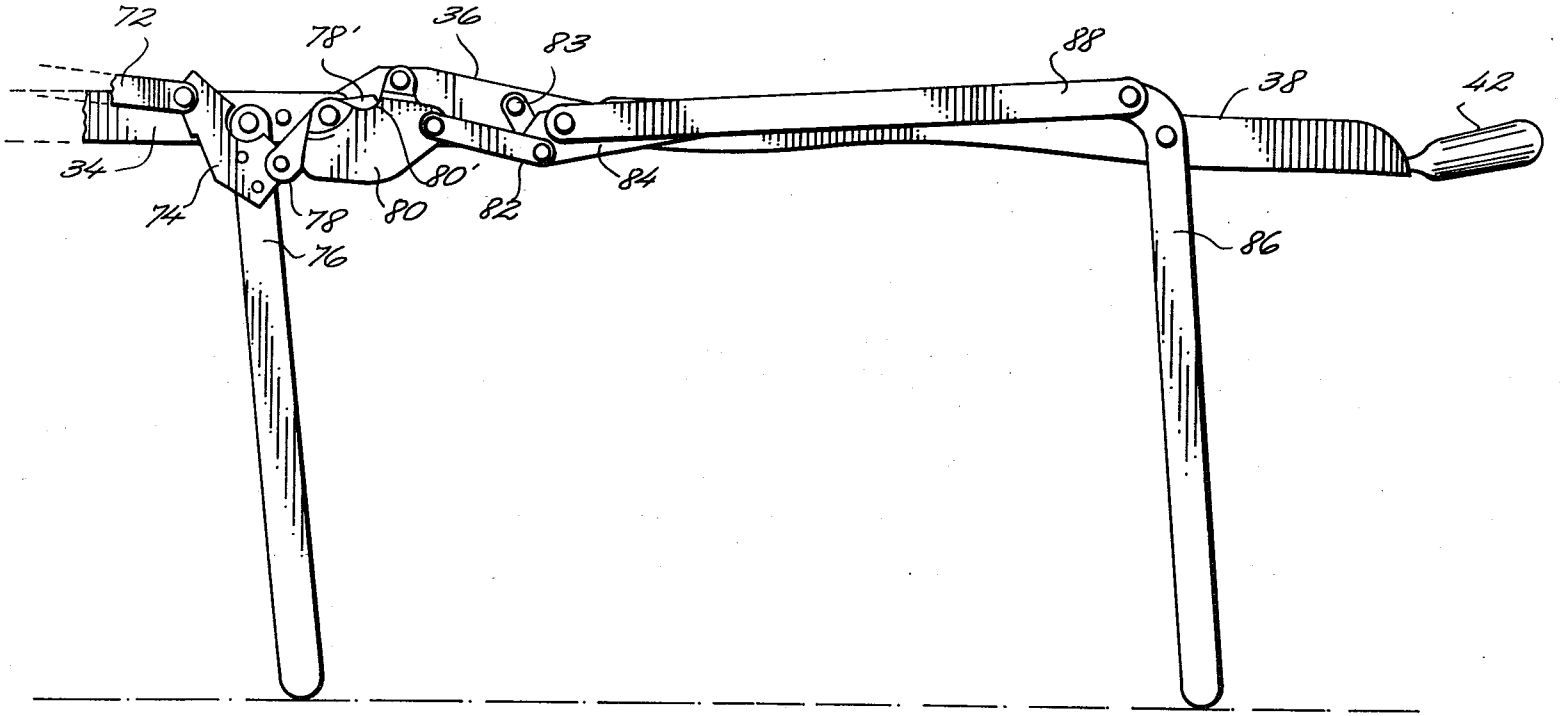

The above-described operation takes place in reverse in refolding the bed structure 20 from its FIG. 4 disposition to its FIG. 1 disposition.

As will be seen from FIG. 4A, the rear end section 32 is supported by the support linkage in the extended position only at its pivotal connection 44 with the main intermediate section 34 by the secondary support link 64, the rearward end of the rear end section 32 thus being free and unsupported, as is conventional. As explained hereinabove, a major problem with conventional supporting arrangements of this general type is their individual failures to prevent the pivotal movement of their respective rear end sections downwardly past the intended horizontal disposition when any significant weight is placed thereupon. In such conventional supporting arrangements, the only provision normally made to prevent this problem is the arrangement of the horizontal flanges of the side rails of the rear end and main intermediate sections to abut in the extended position of the bed frame, this provision having proved generally ineffectual over any significant period of use because the imposition of weight on the rear end section concentrates the stress of the weight at the pivot between the two bed sections which is not capable of providing sufficient rigidity for suitable support in use. This problem is alleviated in the present invention by the cooperative arrangement of the supporting and actuating linkages of the bed frame structure 20 such that the actuating link 70 extends rearwardly from the control link 68 at a very slight downward angle and the provision of a transverse offset 92 in the actuating link 70 (FIG. 6), whereby the offset 92 of the actuating link 70 superposedly abuts the end of the secondary support link 64 at the pivot 44 in the extended position of the bed frame structure (see FIG. 5). In this manner, the actuating link 70 effectively supportingly braces the rear end section 32 in its horizontal disposition of FIG. 4 and prevents counterclockwise pivotal downward movement of the rear end section 32 about the pivot 44 beyond such horizontal disposition. As those skilled in the art will readily understand, the rear end section 32 accordingly is significantly more stable than are the rear end sections in bed structures utilizing conventional support arrangements and will, therefore, have a significantly greater usable life.

The rear end section 32 of the bed frame structure 20 is provided with an arrangement permitting the partial folding thereof in the extended position independently of the remaining components of the structure 20 to dispose the rear end section 32 in an inclined position relative to the other bed sections 34,36, 38 so that users of the sofa bed can comfortably read, view television, or the like. Various arrangements for this purpose are conventional, the folded or inclined position of the rear end section generally being referred to as a "T.V. position." In the bed frame structure 20, the rear end section 32 is uniquely constructed and arranged both to provide for ordinary operational movement thereof to a partially folded T.V. position in the extended position and to permit forward pivoting of the rear end section 32 between the forward end and main intermediate bed sections 38, 34, in folding the bed frame structure 20 from the extended position to provide a more compactly folded structure 20 than that of FIG. 1 to better facilitate shipment and storage of the structure 20.

Figure 5:
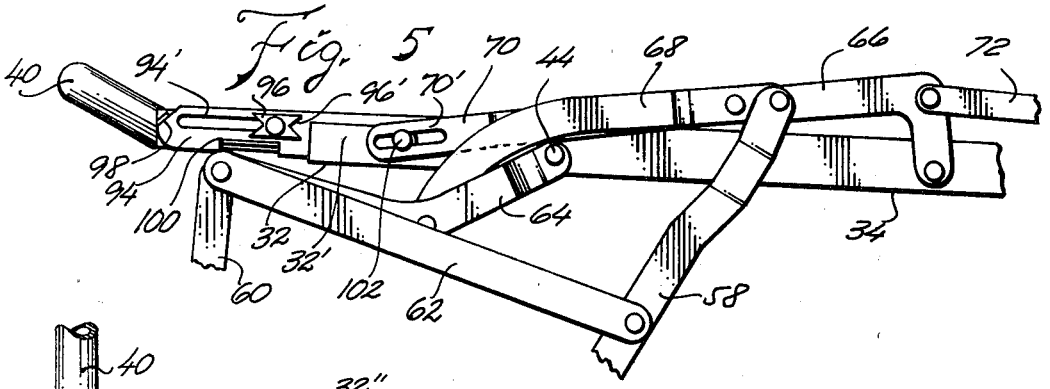
FIG. 5 is an enlarged detailed side elevational view of the rear end section and the support and actuating linkage associated therewith of the bed frame structure in the extended position of FIG. 4.
Figure 6:
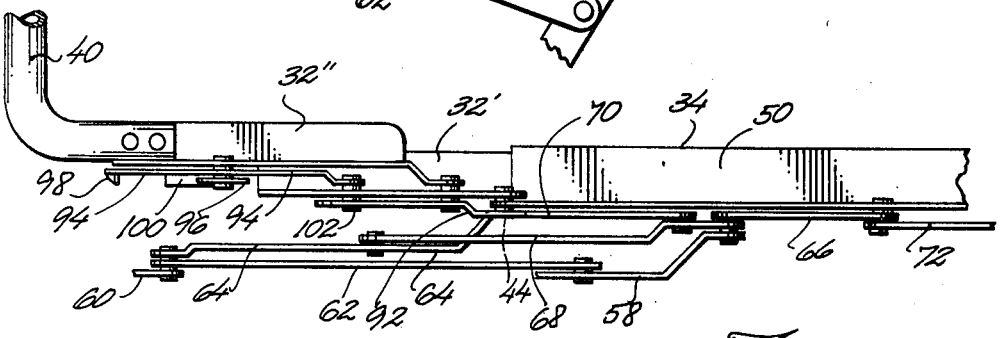
FIG. 6 is a plan view of one side of the portion of the bed frame structure illustrated in FIG. 5.

As will be seen from FIGS. 5 and 6, the rear end section 32 is formed of two angle members 32', 32'', the primary angle member 32' being pivotally connected at one end thereof at 44 to the main intermediate section 34 and the secondary angle member 32'' being pivotally connected at one end thereof to the vertical flange of the angle member 32' at a rearward spacing from the pivot 44. In this manner, the angle members 32', 32'' are arranged to coincidentally lie in the extended position with the secondary angle member 32'' superposedly received and lying within the primary angle member 32' in substantially parallel relation therewith such that the rear end section 32 is horizontally aligned with the other bed sections 32,34,36,38. The pivotal connection of the secondary angle member 32'' to the primary angle member 32' permits the pivotal angular elevation of the secondary angle member 32'' relative to the primary angle member 32' independently of the other bed sections 34,36,38 and of the linkage arrangement of the structure 20.

Figure 7:
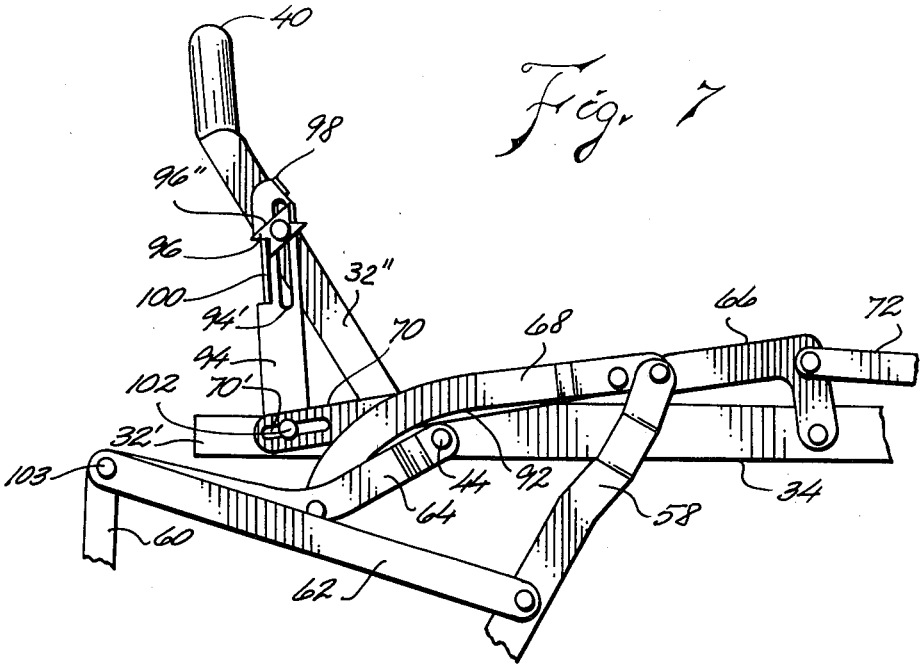
FIG. 7 is a side elevational view similar to FIG. 5 illustrating the rear end section in the partially folded disposition.

To guide and define such pivotal elevational movement of the secondary angle member 32'', a secondary control link 94 is provided (FIG. 7), the control link 94 extending between and being pivotably connected to the primary and secondary angle members 32',32'' at respective spacings from the location of their pivotal connection. As can be seen in FIG. 7, the end of the control link 94 which is pivotally connected to the primary angle member 32' shares its pivotal connection with the rearward end of the rear end section actuating link 70. The other end of the control link 94 is provided with a longitudinal slot 94' through which extends a notched locking member 96 pivoted on the secondary angle member 32'', the slot 94' and the locking members 96 thus forming a lost motion connection between the control link 94 and the secondary angle member 32'' to permit a predetermined amount of guided elevational movement of the secondary angle member 32'' relative to the primary angle member 32'. To permit locking of the secondary angle member 32'' in an elevated T.V. position, the control link 94 is provided at the end thereof connected to the secondary angle member 32' with a transverse projection 98 and with a longitudinal ridge 100 extending along one side of the slot 94'. The transverse projection 98 is angled for engagement within the notches 96' of the locking member 96 and to act as a cam to slightly rotate the locking member 96 upon such engagement. The longitudinal ridge 100 is disposed sufficiently closely alongside the slot 94' for engaging a notch 96' of the locking member 96 when it has been so rotated by the projection 98. In this manner, the secondary angle member 32'' may be pivotally elevated from the disposition thereof in FIG. 5 to cause the locking member 96 to move within the slot 94' and to engage the projection 98 with one of its notches 96' to thereby slightly rotate the locking member 96. Subsequent lowering of the secondary angle member 32'' causes the opposite notch 96' of the locking member 96 to engage the longitudinal projecting portion 100 preventing further downward movement of the secondary angle member 32'' whereby it is locked in an inclined T.V. position (see FIG. 7). Subsequent raising of the secondary angle member 32'' will cause a straight edge 96'' of the locking member 96 to engage the projection 98, thereby turning the locking member 96 to a disposition permitting the lowering of the secondary angle member 32'' to the disposition of FIG. 5.

As will also be seen in FIG. 5, the rear end section actuating link 70 includes a longitudinal slot 70' at the end thereof connected to the rear end section 32, a pin 102 affixed to the rear end section 32 extending through the slot 70' to form a lost motion pivotal connection between the actuating link 70 and the rear end section 32. In this manner, the rear end section 32 is pivotally movable a distance determined by the length of the slot 70' clockwise about its pivot 44 with the main intermediate section 34 independently of the linkage arrangement of the structure 20 (see FIG. 8). As those skilled in the art will accordingly understand, the combination of the two above-described lost motion features of the bed structure 20 providing independent partial folding of the rear end section 32 to a T.V. position and further partial independent forward pivoting of the rear end section 32 uniquely permits the forward folding of the rear end section 32 between the forward end and main intermediate sections 38,34 during folding of the bed structure 20 to thereby better facilitiate shipping and storage of the structure 20 prior to assembly in a sofa bed. According to conventional practice, folding bed frame structure are shipped and stored in an assembled folded condition with springs and fabric included but without a mattress and prior to mounting thereof in a sofa frame. It will therefore be understood that this unique combination of features in the present structure 20 is designed to facilitate such folding when no mattress is disposed within the structure 20.

Figure 9:
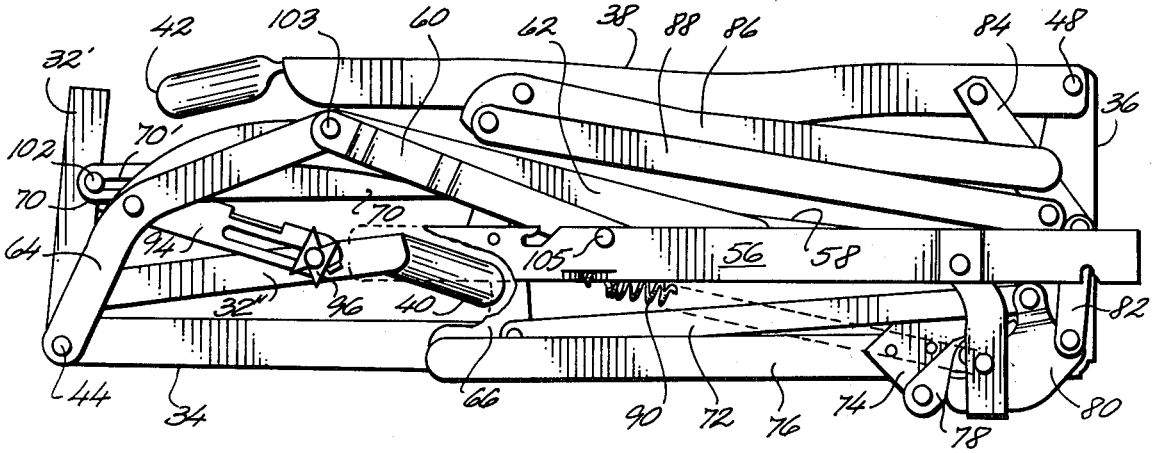
FIGS. 8 and 9 are side elevational views of the folding bed frame structure unmounted in a sofa frame, illustrating the bed frame structure in successive positions in the folding thereof to prepare it for shipment, FIG. 8 showing the folding of the rear end bed section between the forward end and first intermediate bed sections and FIG. 9 showing the fully folded shipping condition of the bed frame structure.
Figure 8:
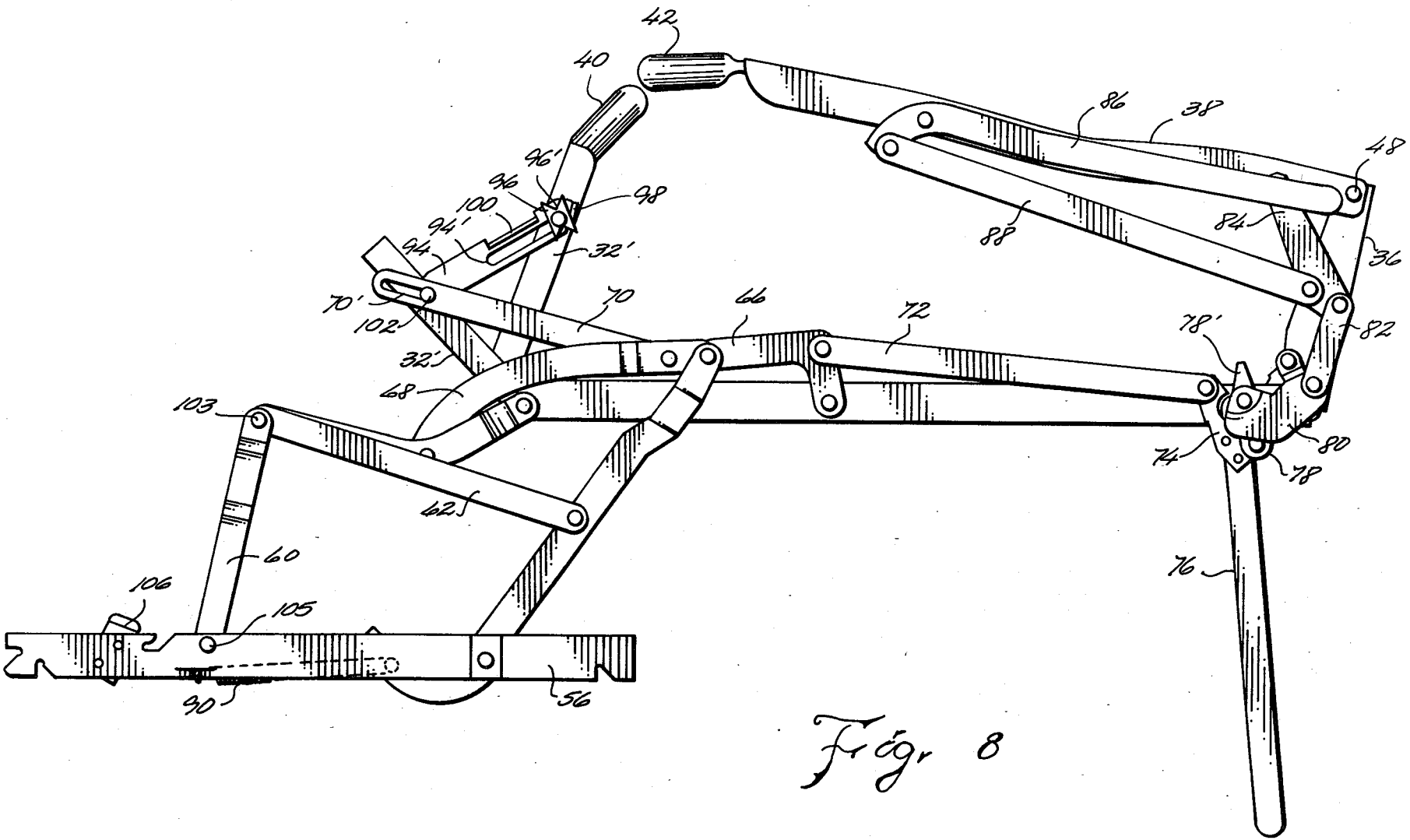

In operating the bed frame structure 20 for this purpose, the bed frame structure 20 is folded to the disposition of FIG. 3 and the rear end section 32 thereof is partially folded such that the secondary angle member 32'' is fully raised to engage the locking member 96 affixed thereto against the projection 98 and is partially pivoted forwardly to cause the pin 102 to engage in the forward end of the slot 70' of the actuating link 70 (see FIG. 8). In the subsequent folding of the bed frame structure 20 from the above-described disposition, the rear end section 32 will fold more forwardly as the afore-described support linkage and the rear end section control and actuating links 68,70 begin to collapsibly move toward their FIG. 2 disposition whereby the rear end section 32 will fold, as illustrated in FIG. 8, into the spacing between the forward end section 38 and the main intermediate section 34. In certain instances, it may be necessary to manually hold the rear end section 32 in its partially folded and pivoted disposition of FIG. 8 to prevent its rearward counterclockwise pivoting in its disposition of FIG. 8 under the influence of gravity. It may also be necessary to manually lift the forward end section 38 slightly in the disposition of FIG. 8 to facilitate the folding of the rear end section 32 into the spacing between the forward end and main intermediate sections 38,34. The fully folded disposition of the bed frame structure 20 according to the above-described operation is illustrated in FIG. 9. Since the rear end section does not extend in an upstanding disposition as in the ordinary folded position of FIG. 1, the bed frame structure 20 is considerably more compact than in the folded position of FIG. 1 and assumes a generally rectangularly prismatic geometric shape with the main intermediate and forward end sections 34,38 forming substantially horizontal stacking surfaces without vertical projection of the rear end section. In this manner, the vertical stacking of a plurality of the bed frame structures 20 is facilitated to permit more efficient use of available shipping and storage space.

According to another feature of the present invention, a stop arrangement is provided to cause the rear end section 32 of the bed frame structure to move in a tighter, more compact arcuate path during an initial portion of its movement from the folded to the extended position and during the corresponding final portion of its return movement from the extended to the folded position. As will be understood from the above description and the accompanying drawings, particularly FIGS. 1–4, the linkage arrangement is constructed to cause the pivot 103 between the outward free end of the rear support link 60 and the control link 62 and the secondary support link 64 to travel arcuately about the fixed pivot 105 of the rear support link 60 on the bracket 56 between a rearward location in the folded position of the bed frame structure (FIG. 1) and a forward location substantially vertically above and slightly forwardly of the fixed pivot 105 in the extended position (FIG. 4), and to provide compound pivotal movement of the bed sections 32,34,36,38 about both the fixed and traveling pivots 105,103 of the rear support link 60 during movement of the bed sections 32,34,36,38 between the folded and extended positions. The above-mentioned stop arrangement, indicated generally at 104 in FIGS. 10 and 11, comprises an inmovable abutment bracket 106 affixed to the support bracket 56 at a rearward spacing from the fixed pivot 105 of the rear support link 60 and extending transversely outwardly therefrom to engage the rear support link 60 during the aforesaid initial and final portions of movement of the bed structure 20.

Figure 11:
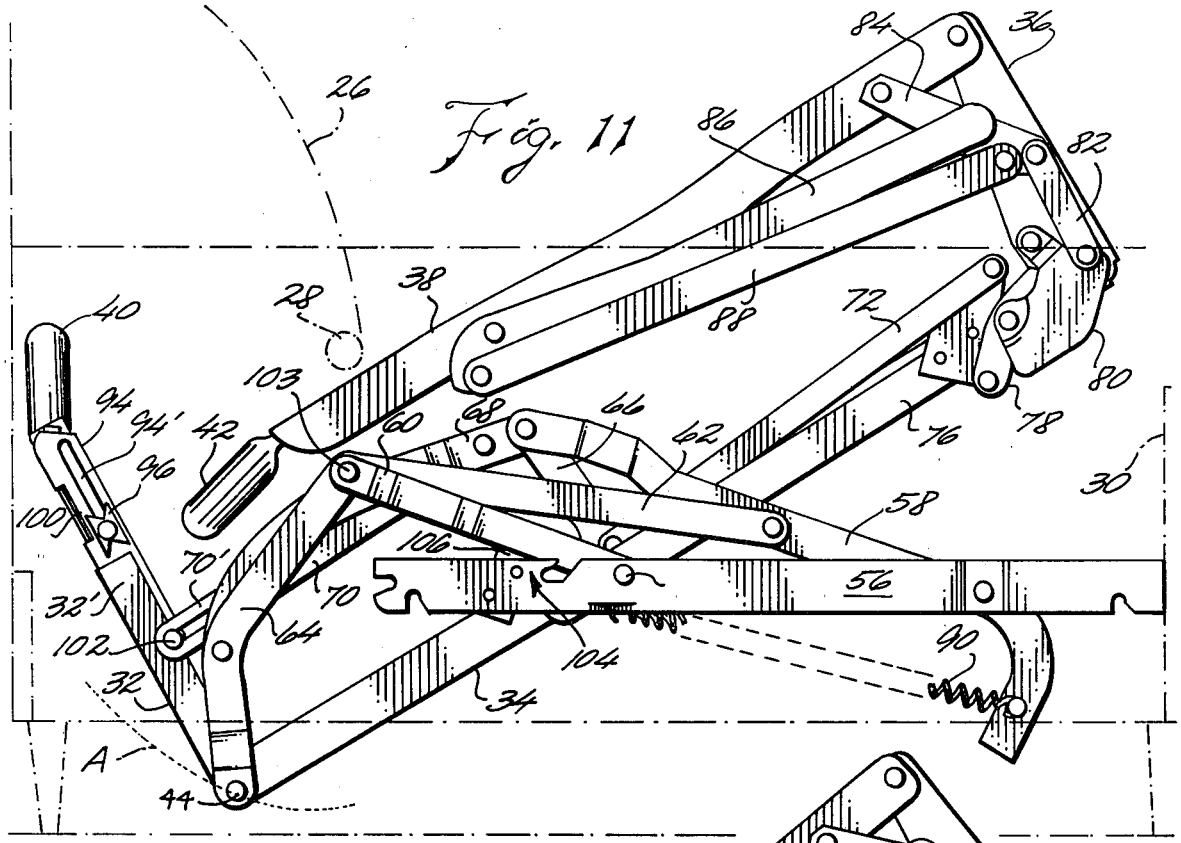
FIGS. 10 and 11 are side elevational views similar to FIGS. 1–4 illustrating the bed frame structure in successive positions in the folding movement thereof occurring in moving the structure from the position of FIG. 2 to the position of FIG. 1, FIG. 10 showing a position of the structure prior to engagement of its support link arrangement with its stop arrangement and FIG. 11 showing a position of the structure subsequent to such engagement.
Figure 10:
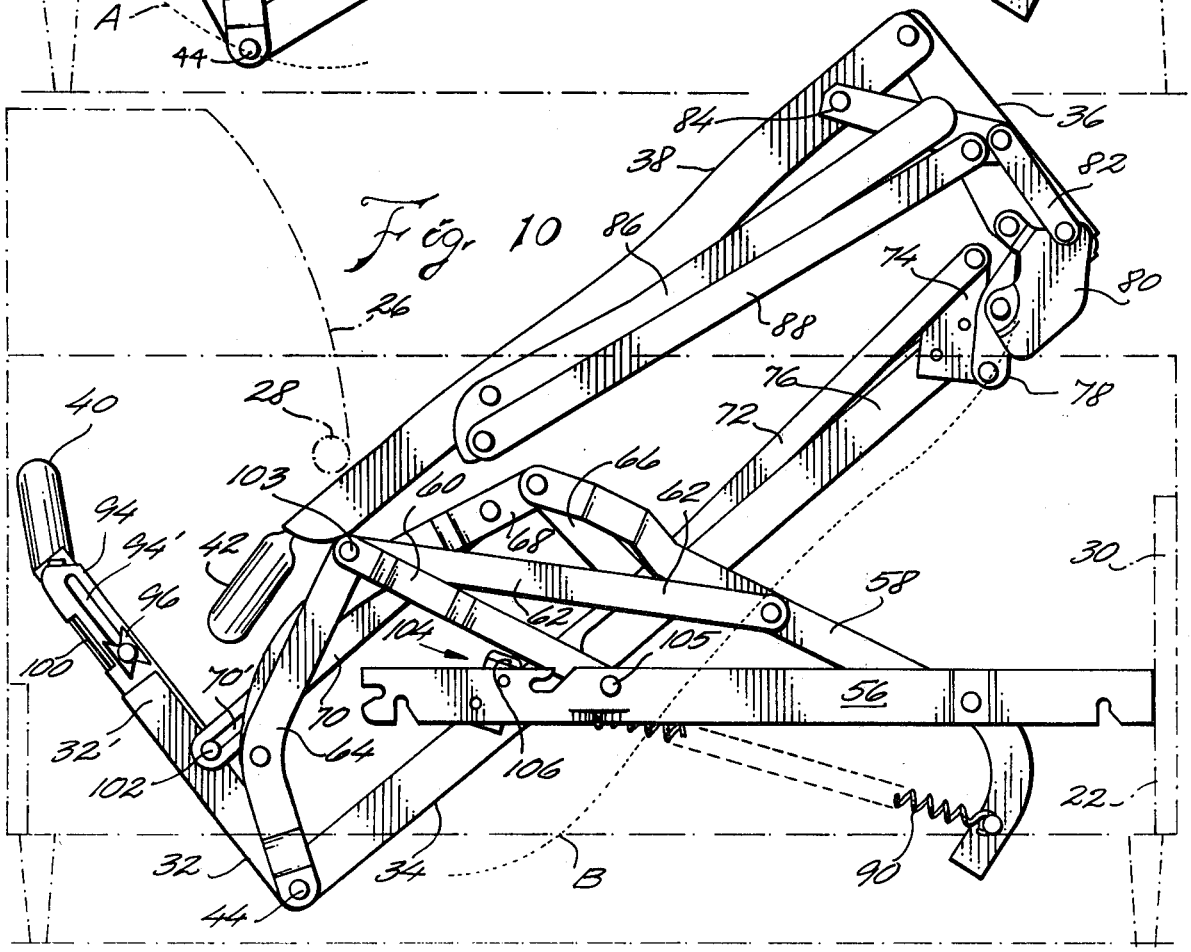

It will be understood that, without the abutment 106, a compound pivotal movement of the bed sections 32,34,36,38 about the fixed and traveling pivots of the rear support link 60 would be imparted to the bed sections 32,34,36,38 through the full range of movement thereof between the folded and extended positions. By providing the abutment 106 for engaging the rear support link 60 during corresponding initial and final portions of the respective movements of the bed structure 20 between its folded and extended positions and its extended and folded positions, the traveling pivot 103 between the rear support link 60, the control link 62 and the secondary support link 64 is effectively fixed during such initial and final portions of movement, whereby the bed frame structure 20 is caused to pivot arcuately during such initial and final portions of movement substantially only about the traveling pivot 103. Referring now to FIGS. 10 and 11, successive intermediate positions in the folding movement of the bed frame structure 20 from the position of FIG. 2 to the position of FIG. 1 are illustrated. FIG. 10 illustrates a position of the structure 20 immediately prior to the abutting engagement of the rear support link 60 against the abutment 106. In moving from the position of FIG. 2 to the position of FIG. 10, the two support links 58,60 pivot rearwardly counterclockwise about their respective fixed pivots on the support bracket 56 whereby their respective pivots at the respective outer ends travel arcuately rearwardly, imparting to the bed sections 32,34,36,38 a compound pivotal movement about these pivots of the two support links 58,60. When the rear support link 60 subsequently engages the abutment 106 in continuing movement toward the fully folded position of FIG. 1 (FIG. 11), the front support link 58 has substantially reached its fully folded disposition of FIG. 1. The engagement of the abutment 106 by the rear support link 60 prevents further rearward pivoting of the rear support link 60 and, accordingly, the final portion of folding movement of the bed frame structure 20 from the position of FIG. 11 to the position of FIG. 1 is substantially completely arcuate pivotal movement about only the pivot 103 at the outward end of the rear support link 60. As will be understood, the rear support link 60 will be constrained to remain in engagement with the abutment 106 during the initial portion of subsequent unfolding movement of the bed frame structure 20 from the position of FIG. 1 to that of FIG. 11, whereby the structure 20 will also pivot arcuately about the pivot 103 during such initial portion of movement.

The advantages of the stop arrangement 104 will thus be apparent to those skilled in the art. Since the location at which the traveling pivot 103 of the rear support link 60 is fixed by the abutment 106 during such initial and final movements is substantially more rearward than the location of the fixed pivot of the rear support link 60, the effective radius of movement of the rearwardmost portions of the bed structure 20, i.e. primarily the rear end section 32, is substantially shortened during such initial and final portions of movement, thereby causing the rear end section 32 to move during such movements in a tighter, more compact arcuate path than during the other portions of movement of the bed sections 32,34,36,38 between the folded and extended positions. The arcuate path of the pivot 44 of the rear end section 32 between the folded position of FIG. 1 and the extend position of FIG. 4 is indicated in FIGS. 10 and 11, the arc A of FIG. 11 showing the relatively tight, compact path of movement of the pivot 44 during the initial and final portions of movement of the arc B of FIG. 10 showing the more extended path of movement of the pivot 44 between the position of FIG. 4 and the position at which the rear support link 60 engages the abutment 106. Additionally, the location at which the traveling pivot 103 is fixed during such initial and final movements is vertically higher than the fixed pivot 105 and is approximately horizontally adjacent the intermediate portion of the vertical extent of the rear end section 32 in its upstanding disposition during such initial and final movements, whereby the arcuate path of movement of the upstanding rear end section 32 during the initial and final movements has a substantially vertical character. As a result of the higher location of the pivot 103 in its fixed position during the initial and final portions of movement, the pivot 44 of the rear end section 32 does not move arcuately to as low a point as it would if the stop arrangement 104 were not utilized and the rear end section 32 thereby receives a compound pivotal movement about both pivots 103 and 105. Accordingly, only a minimal amount of space is required below the structure 20 in its folded position to facilitate unfolding and re-folding movement thereof.

The manipulation of the rear end section 32 into and out of the hollow seat back 26 and around the cross-member 28 thereof is thus uniquely facilitated, the stop arrangement 104 providing compact, substantially vertical movement of the rear end section 32 during the initial and final portions of movement of the bed frame structure 20 to move the rear end section 32 into and out of the hollow seat back 26 and the compound pivotal movement of the structure 20 about the several pivots of the support links 58, 60 constraining the rear end section 32 to move unobstructedly around the cross-member 28 of the seat back 26 respectively subsequent and prior to the initial and final portions of movement, and the bed frame being constrained from inadvertent over-pivoting downwardly.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

I claim:

1. A folding bed frame structure for sofa beds or the like, comprising a plurality of bed sections pivotally connected in end-to-end relation, said bed sections including an end section and an adjacent section pivotally connected to said end section, and linkage means adapted for affixation to a sofa frame or the like and operably associated with said bed sections for supporting said bed sections on said frame and controlling movement of said bed sections in a predetermined pattern between a retracted position in which said bed sections are folded within said frame relative to one another and an extended position in which said bed sections are horizontally aligned, said linkage means including support link means pivotally connected to said adjacent section for supporting said end and adjacent sections, and actuating link means pivotally affixed to said end section at a spacing from said pivotal connection thereof with said adjacent section for transmitting movement of said linkage means to said end section, said actuating link means resting upon said support link means, when said bed sections are in their extended position, to supportingly brace said end section in horizontal alignment with said adjacent section and to prevent pivotal downward movement of said end section about said pivotal connection thereof with said adjacent section beyond said horizontal alignment.

2. A folding bed frame structure for sofa beds or the like according to claim 1 and characterized further in that at least one of said actuating link means and said support link means includes a transversely offset portion to provide for said actuating link means resting upon said support link means.

3. A folding bed frame structure for sofa beds or the like according to claim 1 and characterized further in that said actuating link means includes a transversely offset portion at a spacing from the pivotal connection between said actuating link means and said end section, said offset portion providing for resting of said actuating link means upon said support link means.

4. A folding bed frame structure for sofa beds or the like according to claim 1 or 3 and characterized further in that said support link means is pivotally connected at one end thereof to the pivotal connection between said end section and said adjacent section and said actuating link means extends in said extended position of said bed sections from the location of its pivotable affixation to said end section toward the opposite end of said bed frame structure said actuating link means resting upon said one end of said support link means.

5. A folding bed frame structure for sofa beds or the like, comprising a plurality of bed sections pivotally connected in end-to-end relation, linkage means adapted for affixation to a sofa frame or the like and operably associated with said bed sections for supporting said bed sections on said frame and controlling movement of said bed sections in a predetermined pattern between a rearward retracted position in which said bed sections are folded relative to one another within said frame and a forward extended position in which said bed sections are horizontally aligned, said linkage means including support link means for affixation to said frame for pivotably swingably supporting said bed sections thereon, said support link means having a fixed pivot at the location of affixation thereof to said frame and a traveling pivot spaced therefrom, said traveling pivot moving between a location rearwardly of said fixed pivot in said retracted position and another location forwardly of said rearward location in said extended position, said linkage means being arranged for pivotal movement of said bed sections about both said traveling pivot and said fixed pivot during movement of said bed sections between said retracted and extended positions, and immovable stop means located in the path of movement of said support link means for engagement by said support link means so as to prevent movement of said support link means during an initial portion of the movement of said bed sections from said retracted position toward said extended position and during a final portion of the movement of said bed sections from said extended position to said retracted position to fix said traveling pivot during said initial and final portions of the movements of said initial and final portions of movement about a more rearward point that said fixed pivot thereby causing the rearwardmost extent of said plurality of bed sections to move in a tighter, more compact arcuate path during said initial and final portions of movement than during the other portions of movements of said bed sections between said retracted and extended positions.

6. A folding bed frame structure for sofa beds or the like according to claim 5 and characterized further in that said support link means includes support bracket means for affixation to said frame, said fixed pivot being formed on said support plate means and said immovable stop means being affixed to said support plate means.

7. A folding bed frame structure for sofa beds or the like according to claim 5 and characterized further in that said support link means includes a support link extending between said fixed and traveling pivots at each opposite side of said bed sections and said stop means is arranged at each said opposite side for engagement of said support links.

8. A folding bed frame structure for sofa beds or the like according to claim 5 and characterized further in that said bed frame structure is adapted for use in a sofa frame of the type having an upright, horizontally extending seat back, in that said plurality of bed sections includes a rear end section, and in that said linkage means is arranged to cause said rear end section to assume a generally upstanding disposition in said retracted position and to cause the other bed sections of said plurality of bed sections to be foldedly disposed in said retracted position forwardly of said rear end section, said support link means and said immovable stop means being cooperatively arranged to cause said rear end section to move substantially vertically during said initial and final portions of the movements of said bed sections and said linkage means being further arranged to cause said rear end section to move downwardly and generally horizontally immediately following and preceding said initial and final portions of movement, respectively, whereby said bed frame structure is adapted for compact folding within said sofa frame in said retracted position with said rear end section disposed behind said seat back of said frame and with the other bed sections of said plurality of bed sections disposed below said seat back and said bed sections may be moved between said retracted and extended dispositions with the movement of said rear end section unobstructed by said seat back of said frame.

9. A folding bed frame structure for sofa beds or the like, comprising a plurality of bed sections pivotally connected in end-to-end relation, said bed sections including a rear end section, a first intermediate section pivotally connected to said rear end section, a second intermediate section pivotally connected to said first intermediate section, and a forward end section pivotally connected to said second intermediate section, and linkage means adapted for affixation to a sofa frame or the like and operably associated with said bed sections for supporting said bed sections on said frame and controlling movement of said bed sections in a predetermined pattern between a retracted position in which said bed sections are folded relative to one another within said frame with said rear end section in an upstanding disposition and with said first intermediate section and said forward end section horizontally disposed forwardly thereof in spaced superposed parallel relation and an extended position in which said bed sections are horizontally aligned, said linkage means including actuating link means connected to said rear end section for transmitting movement of said linkage means to said rear end section to actuate and control movement of said rear end section between its horizontal disposition in said extended position and its upstanding disposition in said retracted position, said rear end section including a primary portion pivotally connected to said intermediate section and a secondary portion pivotally supported on said primary portion for movement between a normal position superposed on and substantially parallel with said primary portion and a partially folded position disposed at an angular spacing from said primary portion, said rear end section being at least partially further foldable independent of said intermediate and forward end sections and of said linkage means and said linkage means including lost motion means at the connection between said actuating link means and said rear end section for permitting a predetermined amount of pivotal movement of said rear end section about its pivotal connection with said first intermediate section independent of said linkage means, whereby said rear end section may be selectively folded between said first intermediate section and said forward end section during movement of said bed sections from said extended position to said retracted position.

10. A folding bed frame structure for sofa beds or the like according to claim 9 and characterized further in that said rear end section includes second control link means for guiding movement of said secondary portion angularly with respect to said primary portion, said secondary control link means extending between and being pivotally connected to said primary and secondary portions at respective spacings from the location of the pivotal connection between said primary and secondary portions, one of the pivotal connections between said secondary control link means and said primary and secondary portions including lost motion means for permitting a predetermined amount of guided movement of said secondary portion with respect to said primary portion.

* * * * *